US005356114A

United States Patent [19]

Havard

[11] Patent Number: 5,356,114

[45] Date of Patent: Oct. 18, 1994

[54] TRAVELING VALVE FOR SUCKER ROD PUMP

[75] Inventor: Kenneth R. Havard, Houston, Tex.

[73] Assignee: Mash Oil Tools, Inc., Kingwood, Tex.

[21] Appl. No.: 187,302

[22] Filed: Jan. 26, 1994

[51] Int. Cl.[5] ..... F16K 3/00

[52] U.S. Cl. ..... 251/176; 417/498; 417/555.2

[58] Field of Search ..... 251/186, 339; 417/56, 417/60, 498, 555.2

[56] References Cited

U.S. PATENT DOCUMENTS

| | | | |
|---|---|---|---|
| 1,654,642 | 1/1928 | Geisinger | 251/186 |
| 1,958,858 | 5/1934 | Murray | 251/186 |
| 3,176,619 | 4/1965 | Shaw | 417/60 |
| 4,504,199 | 3/1985 | Spears . | |
| 4,599,054 | 7/1986 | Spears . | |

OTHER PUBLICATIONS

Cameron Iron Works, Inc. Catalog from the 1982–1983 composite catalog, pp. 1839–1846.

Trico Industries, Inc. Bulletin PB 4–1 (1985).

Sidekicker Traveling Valve System brochure from Spears Specialty Oil Tools, Inc.

Hart Gas-Lock Breaker brochure by Havon Machine Works Ltd.

*Primary Examiner*—John C. Fox

*Attorney, Agent, or Firm*—Arnold, White & Durkee

[57] ABSTRACT

The present invention provides a mechanically operated traveling valve for use in a sucker rod pump. The valve includes a cylindrical housing, a base positioned in the bottom of said housing which contains a first portion of a sliding shear seal, and a piston positioned within said housing above said base which contains a second portion of the sliding shear seal. The valve is operable between open and closed positions by reciprocal action of a sucker rod on the piston which opens and closes the sliding shear seal.

20 Claims, 4 Drawing Sheets

TRAVELING VALVE FOR SUCKER ROD PUMP

BACKGROUND

The present invention relates to fluid pumps for elevating fluids from areas such as subterranean hydrocarbon bearing formations. More particularly, the present invention relates to a traveling valve for use on sucker rod pumps.

Conventional oil and gas wells include a cased well bore with a tubing string extending down to the hydrocarbon bearing formation. The casing is perforated at the production level to permit the hydrocarbons to flow into the casing and the bottom of the tubing is generally open to permit the hydrocarbons to flow into the tubing and up to the surface. Oftentimes there is insufficient pressure in a formation to cause oil and other liquids to readily float to the surface. It therefore becomes necessary to install some type of artificial lift system for pumping fluids to the surface.

One of the most common types of artificial lift systems is a sucker rod pump. This type of pump is positioned in the well at the level of the fluids to be removed and is mechanically driven by a series of rods connecting the pump to a pumping unit at the surface.

A sucker rod pump includes the simple combination of a cylinder or barrel with a piston or plunger and a suitable intake valve and a discharge valve. The intake value is often referred to as a standing valve and the discharge valve is often referred to as a traveling valve.

Two of the more common types of sucker rod pumps are the tubing pump in which the pump barrel is attached directly to the tubing and is lowered to the bottom of the well as the tubing is run into the well. The plunger is attached to the bottom of the sucker rod and is positioned within the pump barrel. The intake valve is positioned at the bottom of the pump barrel and the traveling valve is positioned on the plunger. The second type of pump is often referred to as an insert or rod pump and the entire assembly is attached to the bottom of the sucker rod. The barrel is held in place by a special seating nipple or other device positioned within the tubing. This type of pump has the advantage that it can more easily be removed for repair or replacement than a tubing pump. However, it suffers from the disadvantage of having a lower fluid capacity.

The operation of a sucker rod pump is relatively simple. The plunger reciprocates up and down in the barrel under the force of the sucker rod. During the upstroke, the traveling valve is closed and the fluid above the plunger is lifted to the surface by the plunger and sucker rod. At the same time, the standing valve is open allowing fluids to flow into and fill the now evacuated barrel. On the downstroke, the standing valve is closed thus trapping the fluids in the barrel. The traveling valve is opened allowing the compressed fluids to flow through the plunger so they can be lifted during the subsequent cycle.

While sucker rod pumps have been in use for decades and have proven to be economical and reliable, they still experience certain shortcomings and problems. Some of these problems are associated with valves which are generally of the ball and seat variety. This type of valve is opened and closed by pressure differentials across the valve.

One problem that is often encountered is referred to as gas lock. This occurs when there is a substantial amount of gas that flows into the pump with the liquid.

Because of the high compressibility of the gas, insufficient pressure is generated during the downstroke of the pump to open the traveling valve against the hydrostatic pressure of the fluid in the production tubing. Accordingly, the pump can repeatedly cycle without any fluid being lifted to the surface.

Fluid pound is another problem that is often encountered. If the barrel is only partially filled with liquid the plunger forcefully encounters the liquid level part way through the downstroke thus causing severe stress to be placed on the pump. Pump off damage also occurs when the barrel is not completely filled with fluid. Damage occurs in the walls of the working barrel due to overheating of the pump which is caused by the absence of fluid to carry away the heat created by friction in the pump.

Accordingly, it would be a significant advancement in the art to provide a traveling valve for a sucker rod pump which could eliminate the problems of gas lock, fluid pound and pump off damage. Such a traveling valve is disclosed and claimed herein.

SUMMARY OF THE INVENTION

The present invention provides a mechanically operated traveling valve assembly for use in sucker red pumps. The valve includes a cylindrical housing having upper and lower ends. A base is threadedly connected to the lower end of the housing. The base includes a semi-cylindrical portion the top thereof which is positioned within the housing and forms a first portion of a sliding shear seal.

A piston is positioned within the housing above the base and includes a shaft which extends upward through the upper end of the housing. The piston also includes a semi-cylindrical portion on the bottom thereof which forms a second portion of the sliding shear seal and matingly engages the semi-cylindrical portion of the base. The piston is operable between open and closed positions.

A passageway extends through the base with a first end in the bottom of the base forming an inlet to the traveling valve assembly. The other end of the passageway is positioned in the longitudinal planar surface of the semi-cylindrical portion of the base to form an opening in the sliding shear seal.

An aperture extends through the semi-cylindrical portion of the piston. This aperture is in alignment with the second end of the first passageway when the valve is in the open position. An outlet is formed in the top of the housing around the shaft to permit fluid passing through the sliding shear seal and the housing to exit into the production tubing.

In the preferred embodiment, the sliding shear seal includes a tungsten carbide plate positioned in the longitudinal planar surface of the semi-cylindrical portion of the base. This plate has an opening corresponding to the second end of the passageway through the base.

A tungsten carbide disk is positioned within a recess in the longitudinal planar surface of the semi-cylindrical portion of the piston. A spring is placed in the recess behind the tungsten carbide disk. The disk is sized, and positioned such that it occludes the second end of the passageway through the base when the valve is in the closed position.

The piston includes a shoulder which engages the top of the semi-cylindrical portion of the base when the valve is in the open position to cause the valve to descend within the tubing. The piston also includes a planar surface to engage a shoulder in the top of the housing when the valve assembly is in the closed position to lift the valve within the tubing.

DETAILED DESCRIPTION OF THE PREFERRED EMBODIMENTS

The present invention provides a mechanically operated traveling valve assembly for use with sucker rod pumps. This valve assembly eliminates the problems of gas lock, fluid pound and pump off damage that are often associated with conventional ball and seal type traveling valves. Additionally, since the traveling valve is mechanically operated, it can be used at any given attitude making it an excellent application for horizontal or deviated wells.

The invention is best understood by reference to the attached drawings in which like parts are designated with like numerals.

Figure 1:
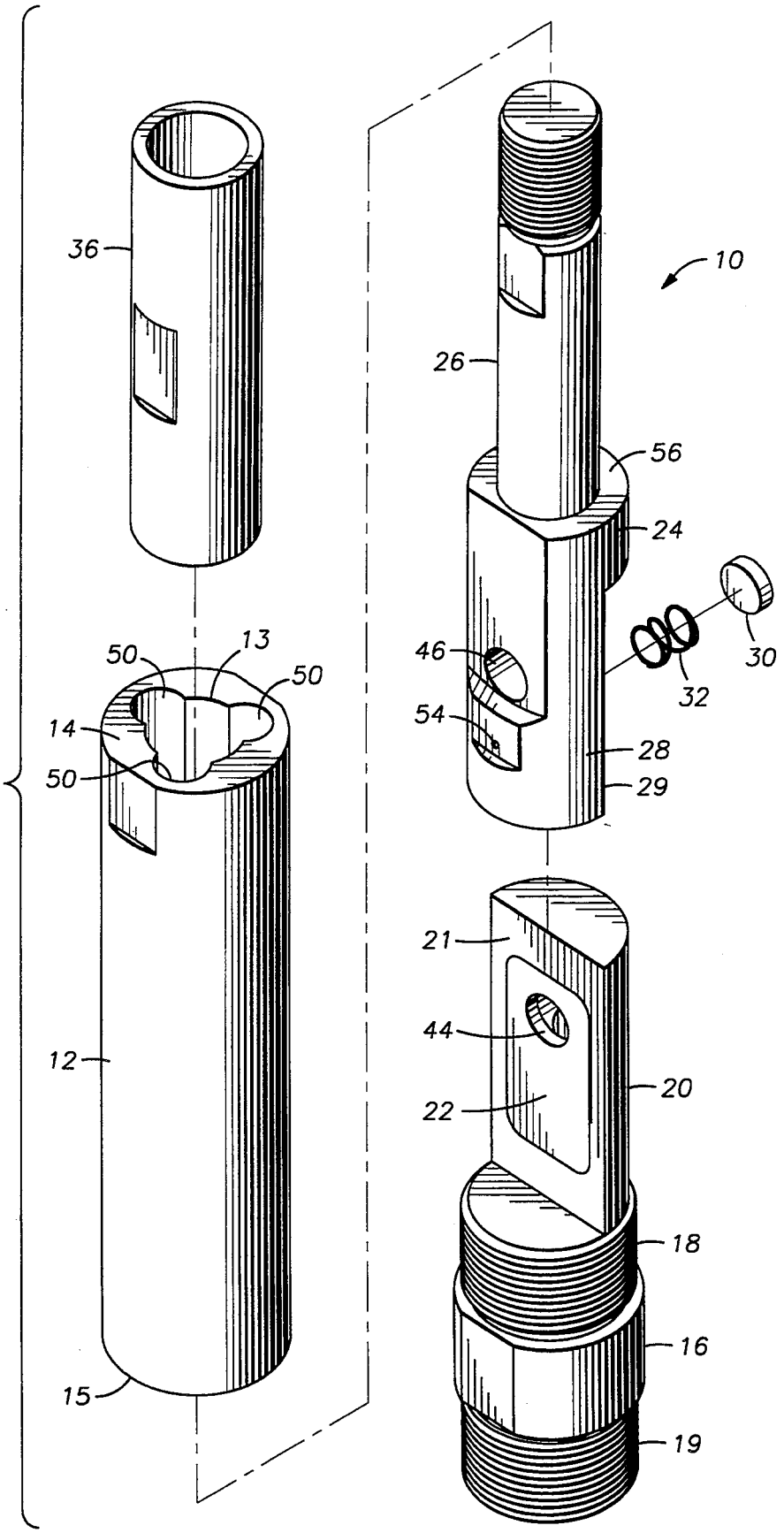
FIG. 1 is an exploded perspective view of a preferred embodiment of the present invention.

FIG. 1 illustrates an exploded perspective view of a preferred embodiment of the traveling valve of the present invention generally designated at 10. Valve 10 includes a cylindrical housing 12 having an upper end 14 and a lower end 15.

A base 16 with threads 18 is threadedly connected into the lower end 15 of housing 12. Base 16 includes a semi-cylindrical portion 20 on the top thereof with a longitudinal planar surface 21 to form a portion of a sliding shear seal. A tungsten carbide plate 22 having an aperture 44 is placed within the longitudinal planar surface 21 of the semi-cylindrical portion 20 such that the surface of the plate is flush with the surface of the semi-cylindrical portion. Plate 22 is secured in place by brazing or any other suitable means to hold it in place and provide a fluid tight seal between plate 22 and base 16. Base 16 also includes threads 19 to connect valve 10 to the top of a conventional plunger in a sucker rod pump.

A piston 24 is positioned within housing 12 above base 16. Piston 24 includes a shaft 26 which extends through aperture 13 in upper end 14 of housing 12.

Figure 2:
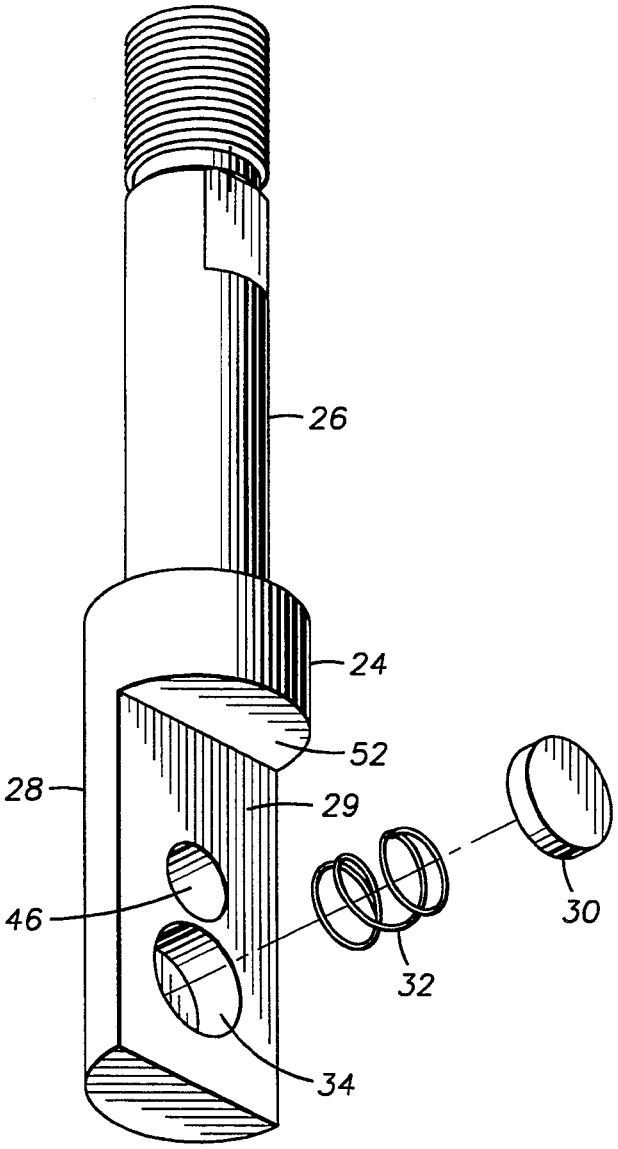
FIG. 2 illustrates one of the major pieces of FIG. 1 which has been rotated 90°.
Figure 3:
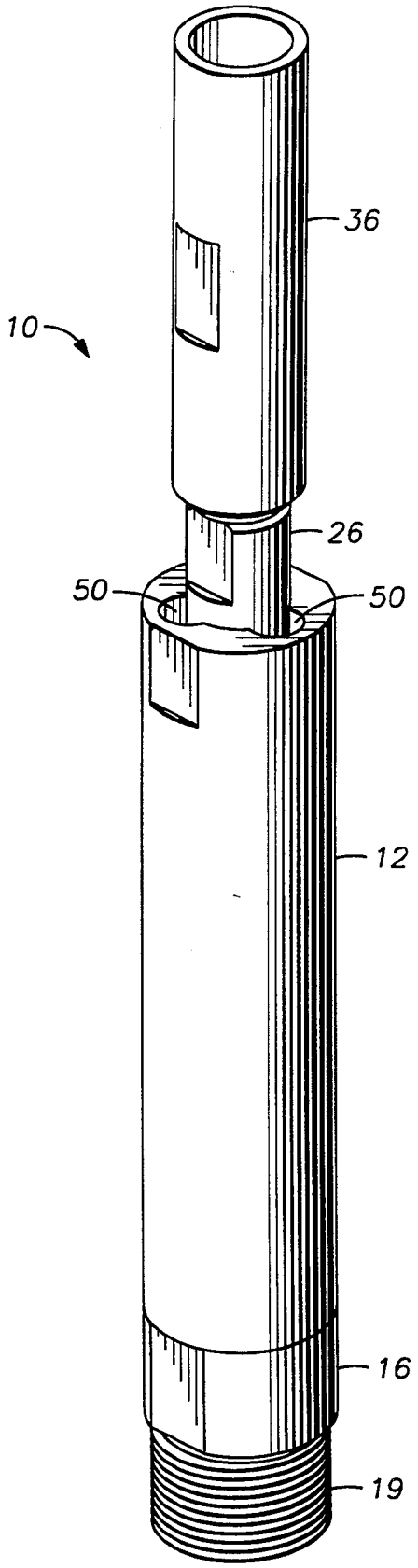
FIG. 3 is a perspective view of the assembled valve.
Figure 4:
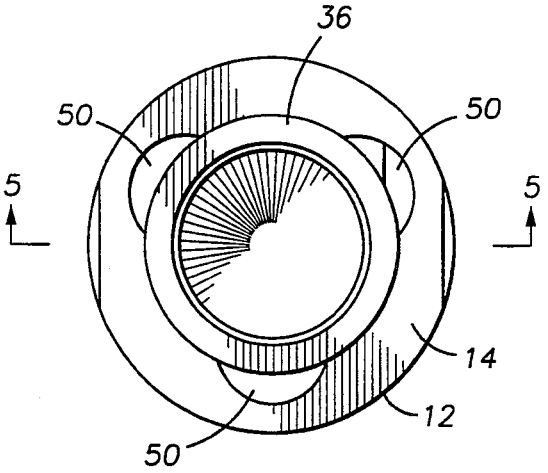
FIG. 4 is a top planar view of the preferred embodiment.

Piston 24 also includes a semi-cylindrical portion 28 on the bottom thereof with a longitudinal planar surface 29 which matingly engages semi-cylindrical portion 20 to form the other half of the sliding shear seal. A tungsten carbide disk 30 and a spring 32 are placed within a recess 34 (see FIG. 2) in semi-cylindrical portion 28. Disk 30 engages Plate 22 to form the remainder of the sliding shear seal.

While the preferred embodiment uses a tungsten carbide plate and a tungsten carbide disk to form portions of the sliding shear seal, it will be appreciated by those skilled in the art that other abrasion resistant materials could also be used. For example, ceramics and various metals can be used depending on the environment in which the pump will be used.

Valve 10 also includes a coupling 36 which is threadedly connected to the top of shaft 26 on piston 24. Coupling 36 can then be threadedly connected to a sucker rod. Accordingly, valve 10 is mechanically operated between open and closed positions by the reciprocal action of the sucker rod on piston 24.

Figure 5:
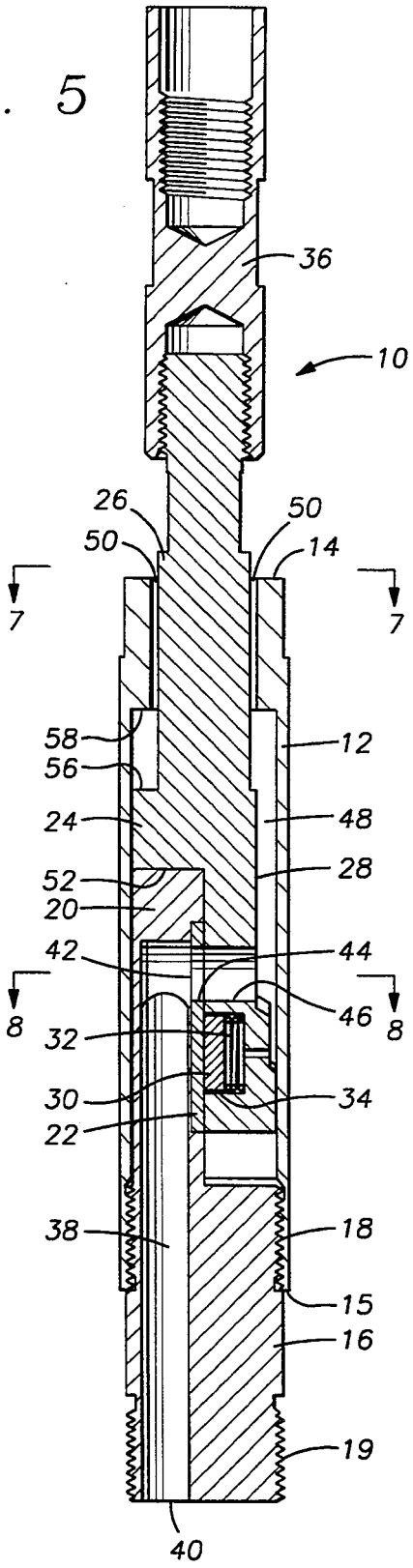
FIG. 5 is a longitudinal cross-sectional view of the preferred embodiment taken along lines 5—5 of FIG. 4 illustrating the valve in the open position.
Figure 6:
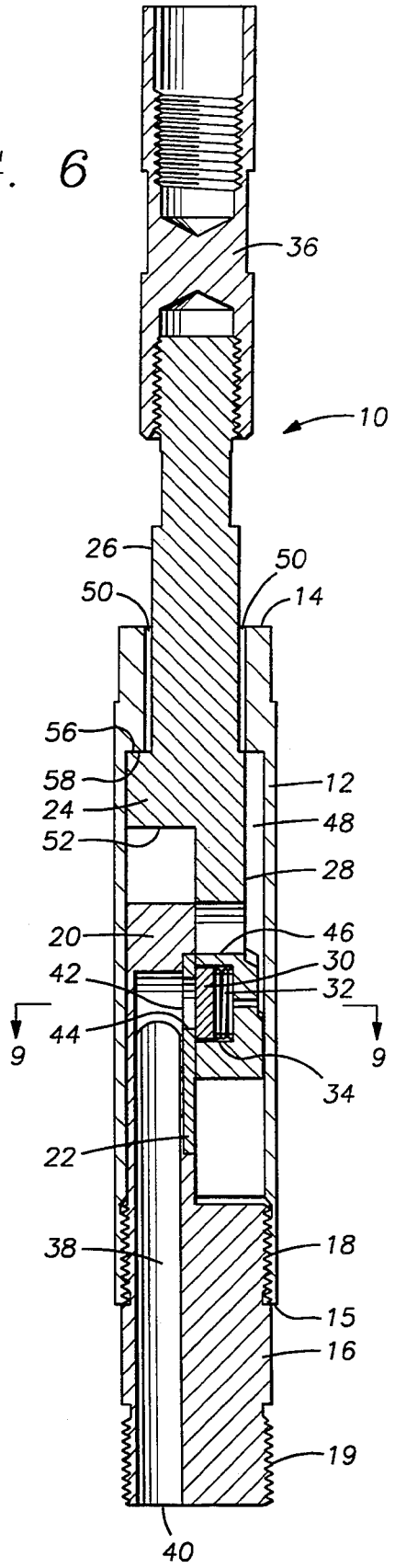
FIG. 6 is a longitudinal cross-section similar to FIG. 5 but showing the valve in the closed position.

Reference is next made to FIGS. 5 and 6 which are longitudinal cross-sectional views of valve 10 in its open and closed positions.

Base 16 includes a passageway 38 extending substantially through the length thereof. Passageway 38 includes a first opening 40 in the bottom of base 16 to permit fluids to flow into valve 10. Passageway 38 includes a second opening 42 facing longitudinal planar surface 21 which permits the fluid to flow through aperture 44 in carbide plate 22.

When valve 10 is in the open position, an aperture 46 in semi-cylindrical portion 28 of piston 24 is aligned with aperture 44 in plate 22 to allow the fluid to flow through the sliding shear seal. The fluid then flows through a passageway 48 around piston 24 within housing 12. Passageway 48 is formed on a side of piston 24 opposite the longitudinal planar surface 21 on semi-cylindrical portion 20. The fluid can then pass through a plurality of passageways 50 formed in upper end 14 of housing 12 and into the production tubing.

Figure 7:
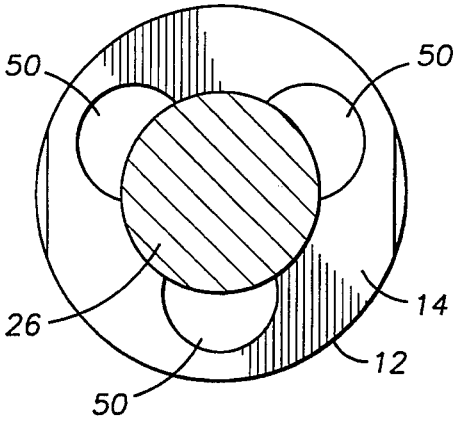
FIG. 7 is a cross-sectional view of the valve taken along lines 7—7 of FIG. 5.
Figure 8:
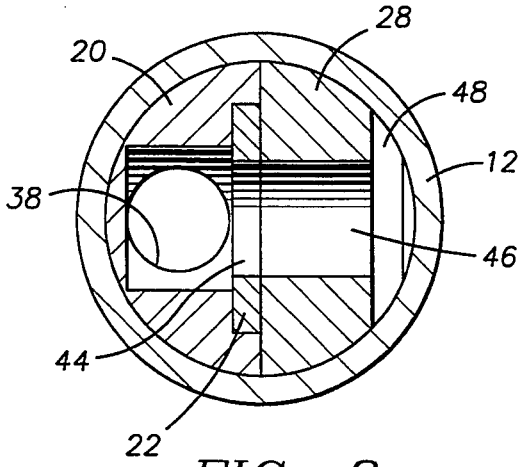
FIG. 8 is a cross-sectional view of the valve taken along lines 8—8 of FIG. 5.
Figure 9:
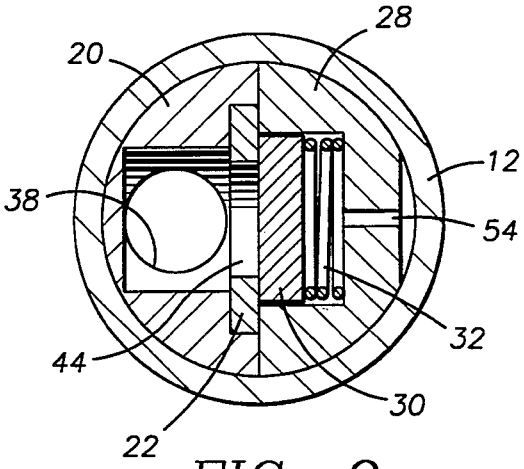
FIG. 9 is a cross-sectional view of the valve taken along lines 9—9 of FIG. 6.

In the preferred embodiment there are three passageways 50 (see FIGS. 1 and 7) in the upper end of housing 12. They are cylindrical in shape and intersect aperture 13 through which shaft 26 reciprocates. Of course, it will be understood by those skilled in the art that the size, shape, number and arrangement of passageways 50 can be adjusted depending Upon the size of the valve and the required flow rates.

Piston 24 also includes a shoulder 52 which engages the top of semi-cylindrical portion 20 of base 16 to force the remainder of valve 10 and the plunger downward during the downstroke of a sucker rod pump.

When traveling valve 10 goes from the open position illustrated in FIG. 5 to the closed position illustrated in FIG. 6, disk 30 slides along plate 22 until it occludes aperture 44 in plate 22. Disk 30 is urged against plate 22 to create a fluid tight seal by spring 32 and hydrostatic pressure of fluid above disk 30 through aperture 54 which places recess 34 in fluid communication with passageway 48.

When valve 10 is in the closed position, a surface 56 on piston 24 engages a shoulder 58 in the upper end of housing 12. The abutment of surface 56 with shoulder 58 positions disk 30 with plate 22 such that disk 30 occludes aperture 44. Disk 30 is larger in diameter than aperture 44. Additionally, the abutment of surface 56 with shoulder 58 transmits the force of the sucker rod during the upstroke to the remainder of valve 10 thus causing it to rise within the production tubing.

As the sucker rod begins its downstroke, the downward movement of piston 24 mechanically opens the sliding shear seal as disk 30 slides along plate 22. This allows any gas within the pump to escape through valve 10 and be replaced with fluid above valve 10. This eliminates gas lock within the pump and reduces fluid pound and pump off damage by filling the barrel of the pump with fluid.

Figure 10:
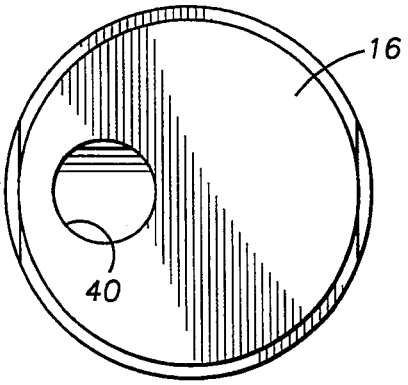
FIG. 10 is a bottom planar view of the valve illustrated in FIGS. 1–9.
Figure 11:
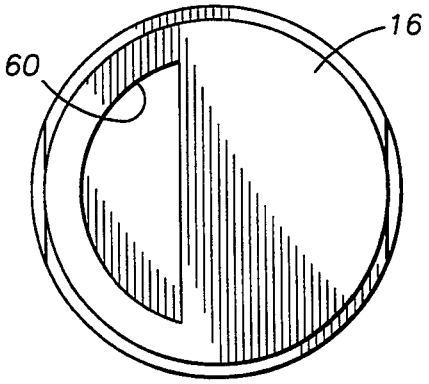
FIG. 11 is a bottom planar view of an alternative embodiment of the present invention.

Reference is next made to FIG. 10 which illustrates a bottom planar view of the embodiment illustrated in FIGS. 1–9. As can be seen in FIG. 10, passageway 38 is cylindrical in shape and is formed by drilling a hole through base 16. An alternative embodiment is illustrated in FIG. 11 which shows a passageway 60 having a semi-cylindrical configuration. This configuration provides a greater cross-sectional area and thus allows a higher fluid flow through base 16.

While the principal use of the present invention is in oil wells, it is also designed to remove liquids, such as water, from gas wells. The fluids are removed in the tubing and the gas is produced up the casing. The ability of the valve to eliminate gas lock, fluid pound and pump off damage makes it ideal for this application.

While the invention has been described with respect to the presently preferred embodiments, it will be appreciated by those skilled in the art that many changes could be made to the design of the valve without departing from its spirit or essential characteristics. For example, the base and housing could be connected to the sucker rod rather than the piston. Additionally, the size, orientation and number of passageways could be changed to allow for different flow rates. Accordingly, all changes or modifications which come within the meaning and range of equivalency of the claims are to be embraced within their scope.

I claim:

1. A mechanically operated traveling valve for use in a sucker rod pump comprising:

a cylindrical housing having a lower end containing an inlet and an upper end containing an outlet; and a mechanically operated sliding shear seal positioned within said housing, said seal being operable between open and closed positions by reciprocal action of a sucker rod.

2. A mechanically operated traveling valve as defined in claim 1 further comprising:

a base, threadedly connected to the lower end of said housing, said base including a first semi-cylindrical portion positioned within said housing and containing a first portion of said sliding shear seal; and a piston positioned within said housing above said base with a shaft extending through said upper end of said housing, said piston including a second semi-cylindrical portion which matingly engages the first semi-cylindrical portion of said base and contains a second portion of said sliding shear seal.

3. A mechanically operated traveling valve as defined in claim 2 further comprising:

a first passageway extending substantially through the length of said base with a first end in the bottom of said base forming said inlet to said traveling valve and a second end positioned in a longitudinal planar surface of said first semi-cylindrical portion to form an opening in said sliding shear seal; and an aperture extending through said second semi-cylindrical portion of said piston, said aperture being in alignment with said second end of said first passageway when said valve is in the open position, said aperture being in fluid communication with said outlet in said upper end of said housing.

4. A mechanically operated traveling valve as defined in claim 3 further comprising a plate positioned in a longitudinal planar surface of said first semi-cylindrical portion, said plate having an aperture formed therein corresponding to said second end of said first passageway.

5. A mechanically operated traveling valve as defined in claim 4 wherein said plate is formed from tungsten carbide.

6. A mechanically operated traveling valve as defined in claim 4 further comprising a disk positioned within a recess in a longitudinal planar surface of said second semi-cylindrical portion of said piston, said disk being aligned and positioned such that it occludes said aperture in said plate when said valve is in the closed position.

7. A mechanically operated traveling valve as defined in claim 6 wherein said disk is formed from tungsten carbide.

8. A mechanically operated traveling valve as defined in claim 6 wherein said piston further comprises a shoulder which engages the top of said first semi-cylindrical portion of said base when said valve is in the open position.

9. A mechanically operated traveling valve as defined in claim 8 wherein said piston further comprises a surface to engage a shoulder in the top of said housing when said valve is in the closed position.

10. A mechanically operated traveling valve for use in a sucker rod pump comprising:

a cylindrical housing having upper and lower ends;

a base, threadedly connected to the lower end of said housing, said base including a first semi-cylindrical portion positioned within said housing and forming a first portion of a sliding shear seal; and a piston positioned within said housing above said base with a shaft extending through said upper end of said housing, said piston including a second semi-cylinder portion which matingly engages the first semi-cylinder portion of said base and forms a second portion of said sliding shear seal, said piston being operable between open and closed positions.

11. A mechanically operated traveling valve as defined in claim 10 further comprising:

a first passageway extending substantially through the length of said base with a first end in the bottom of said base forming an inlet to said traveling valve and a second end positioned in a longitudinal planar surface of said first semi-cylindrical portion to form an opening in said sliding shear seal;

an aperture extending through said second semi-cylindrical portion of said piston, said aperture being in alignment with said second end of said first passageway when said valve is in the open position; and an outlet formed in the top of said housing, said outlet being in fluid communication with said aperture.

12. A mechanically operated traveling valve as defined in claim 11 further comprising a plate positioned in a longitudinal planar surface of said first semi-cylindrical portion, said plate having an aperture therein corresponding to said second end of said first passageway.

13. A mechanically operated traveling valve as defined in claim 12 further comprising a disk positioned within a recess in a longitudinal planar surface of said second semi-cylindrical portion of said piston, said disk being larger in diameter than said aperture in said plate and being aligned and positioned such that it occludes said aperture in said plate when said valve is in the closed position.

14. A mechanically operated traveling valve as defined in claim 13 wherein said plate and said disk are formed from tungsten carbide.

15. A mechanically operated traveling valve as defined in claim 13 further comprising a spring positioned within said recess behind said disk for urging said disk against said plate.

16. A mechanically operated traveling valve as defined in claim 13 wherein said piston further comprises a shoulder which engages the top of said first semi-cylindrical portion of said base when said valve is in the open position.

17. A mechanically operated traveling valve as defined in claim 16 wherein said piston further includes a surface to engage a shoulder in the top of said housing when said valve is in the closed position.

18. A mechanically operated traveling valve as defined in claim 11 wherein said first passageway is generally cylindrical in shape.

19. A mechanically operated traveling valve as defined in claim 11 wherein said first passageway is generally semi-cylindrical in shape.

20. A mechanically operated traveling valve for use in a sucker rod pump comprising:

a cylindrical housing having upper and lower ends;

a base, threadedly connected to the lower end of said housing, said base including a first semi-cylindrical portion positioned within said housing, said base having a tungsten carbide plate positioned in a longitudinal planar surface of said first semi-cylindrical portion, said plate forming a first portion of a sliding shear seal and having an aperture therein, said base also including a first passageway extending substantially through the length thereof with a first end in the bottom of said base forming an inlet to said traveling valve and a second end positioned such that it corresponds to said aperture in said plate;

a piston positioned within said housing above said base with a shaft extending through said upper end of said housing, said piston including a second semi-cylindrical portion which matingly engages the first semi-cylindrical portion of said base, said piston including a tungsten carbide disk positioned within a recess in a longitudinal planar surface of said second semi-cylindrical portion, said disk being larger in diameter than said aperture in said plate and being aligned and positioned such that it occludes said aperture in said plate when said valve is in the closed position, said second semi-cylindrical portion of said piston also including an aperture extending therethrough, said aperture being in alignment with said aperture in said carbide plate when said valve is in the open position;

a shoulder formed on said piston such that it engages the top of said first semi-cylindrical portion of said base when said valve is in the open position; and a planar surface on said piston which engages a shoulder in the top of said housing when said valve is in the closed position.

* * * * *